United States Patent [19]

Ovaska

[11] Patent Number: 4,940,117

[45] Date of Patent: Jul. 10, 1990

[54] PROCEDURE FOR THE TUNING OF THE POSITION CONTROLLER OF AN ELEVATOR

[75] Inventor: Seppo Ovaska, Hyvinkaa, Finland

[73] Assignee: Kone Elevator GmbH, Switzerland

[21] Appl. No.: 310,129

[22] Filed: Feb. 15, 1989

[30] Foreign Application Priority Data

Feb. 16, 1988 [FI] Finland ..... 880724

[51] Int. Cl.[5] ..... B66B 1/34

[52] U.S. Cl. ..... 187/101; 187/113

[58] Field of Search ..... 187/101, 112, 113, 116, 187/124, 129, 130, 133, 134

[56] References Cited

U.S. PATENT DOCUMENTS

| | | | |
|---|---|---|---|
| 4,256,203 | 3/1981 | Masel | 187/113 |
| 4,337,847 | 7/1982 | Schröder et al. | 187/101 |
| 4,367,811 | 1/1983 | Yoneda et al. | 187/129 |
| 4,493,399 | 1/1985 | Kajiyama | 187/113 |
| 4,700,810 | 10/1987 | Otala | 187/101 |

*Primary Examiner*—Philip H. Leung
*Assistant Examiner*—W. E. Duncanson, Jr.
*Attorney, Agent, or Firm*—Nixon & Vanderhye

[57] ABSTRACT

A procedure for the tuning of a position controller of an elevator is disclosed wherein an artificial excitation signal is input to the elevator drive system, the response corresponding to the excitation is measured, a mathematical model of the elevator system is calculated, the behavior of the elevator system is simulated, control parameter values minimizing the difference between the target position values and the actual position values are found, individual differences in the vicinity of the ultimate target position are weighted by a large factor, the position control parameter values are reset to optimized values, a real excitation signal is input to the elevator drive system, the model parameters are calculated again, and the above sequence of operations is repeated until the model parameter values and the control parameter values converge.

10 Claims, 2 Drawing Sheets

PROCEDURE FOR THE TUNING OF THE POSITION CONTROLLER OF AN ELEVATOR

BACKGROUND OF THE INVENTION

1. Field of the Invention

The present invention relates to a procedure for the tuning of the position controller of an elevator.

2. Description of Related Prior Art

The tuning of the position controller of an elevator is currently based on the use of a step response and a control surface. In computer-aided tuning of the position controller, this leads to a long settling time or oscillation around the target position. It is therefore difficult to achieve a tuning condition which ensures that the elevator has optimal stopping characteristics, in other words, that the elevator's speed reaches zero at the same instant when the elevator reaches the targeted stopping position.

SUMMARY OF THE INVENTION

Accordingly, in the present invention there is provided a procedure for tuning a position controller of an elevator drive system in an elevator system, wherein an artificial excitation signal is supplied to the position controller of the elevator drive system, the response corresponding to that artificial excitation signal is measured, a mathematical model of the elevator system is calculated, the behaviour of the elevator system is simulated, control parameter values minimizing the difference between the values for target positions and the values for actual positions are calculated, individual differences in the vicinity of the ultimate target position are weighted by a large factor, the position control parameter values are reset to optimized values, a real excitation signal is input to the elevator drive system, the model parameters are calculated again, and the above sequence of operations is repeated until the model parameter values and the control parameter values converge.

Compared to the step response method of tuning, the procedure of the invention provides the advantage that an optimal setting of the elevator control parameter values and optimal stopping characteristics are both achieved thereby.

In a preferred embodiment of the invention the values of the control parameters are calculated by the minimum-p method.

In a preferred embodiment of the invention the controller used in the procedure is a digital PID controller.

The present invention allows automatic selection of optimum terms for the PID controller. No special measuring equipment is required for the adjustments. The procedure of the invention shortens the time required for the starting up of the elevator after installation or alterations. The procedure enables an elevator system to be installed without the help of specially trained personnel.

In another preferred embodiment of the invention long-term changes are compensated for by automatically calculating the control parameter values at regular intervals.

In still another preferred embodiment of the invention variations in dynamic characteristics of the elevator system are compensated for by means of a table of parameters stored in memory.

Further objects, features and advantages of the invention will become apparent to those skilled in the art from the following description when taken in conjunction with the accompanying drawings, in which:

FIG. 1 is a diagram showing the operating principle of a position servo unit provided with a tuning device for use in the procedure of the invention, FIG. 2*a* shows a curve representing target position values as a function of time, FIG. 2*b* is a curve representing the actual elevator position as a function of time when the position controller is tuned by the step response method, and FIG. 2*c* is a curve representing the actual elevator position as a function of time in a system with the position controller tuned as provided by the procedure of the invention.

DESCRIPTION OF PREFERRED EMBODIMENTS

The following is a description of the procedure for automatic tuning of the control parameter values. Under ideal circumstances, this procedure always results in optimal stopping characteristics of the elevator. The procedure is based on minimizing the difference between a "target function" and a "result function" by the minimum-p method. This method is described, for example, in R. W. Daniels' book "An Introduction to Numerical Methods and Optimization Techniques", North Holland, New York, N.Y., U.S.A., 1978. In the present invention the "target function" is the value for the target positions and the "result function" is the values for actual elevator positions. The procedure of the present invention can be used for the optimization of the coefficients used in PID controllers and of control polynomials of a more general nature as well.

Figure 1:
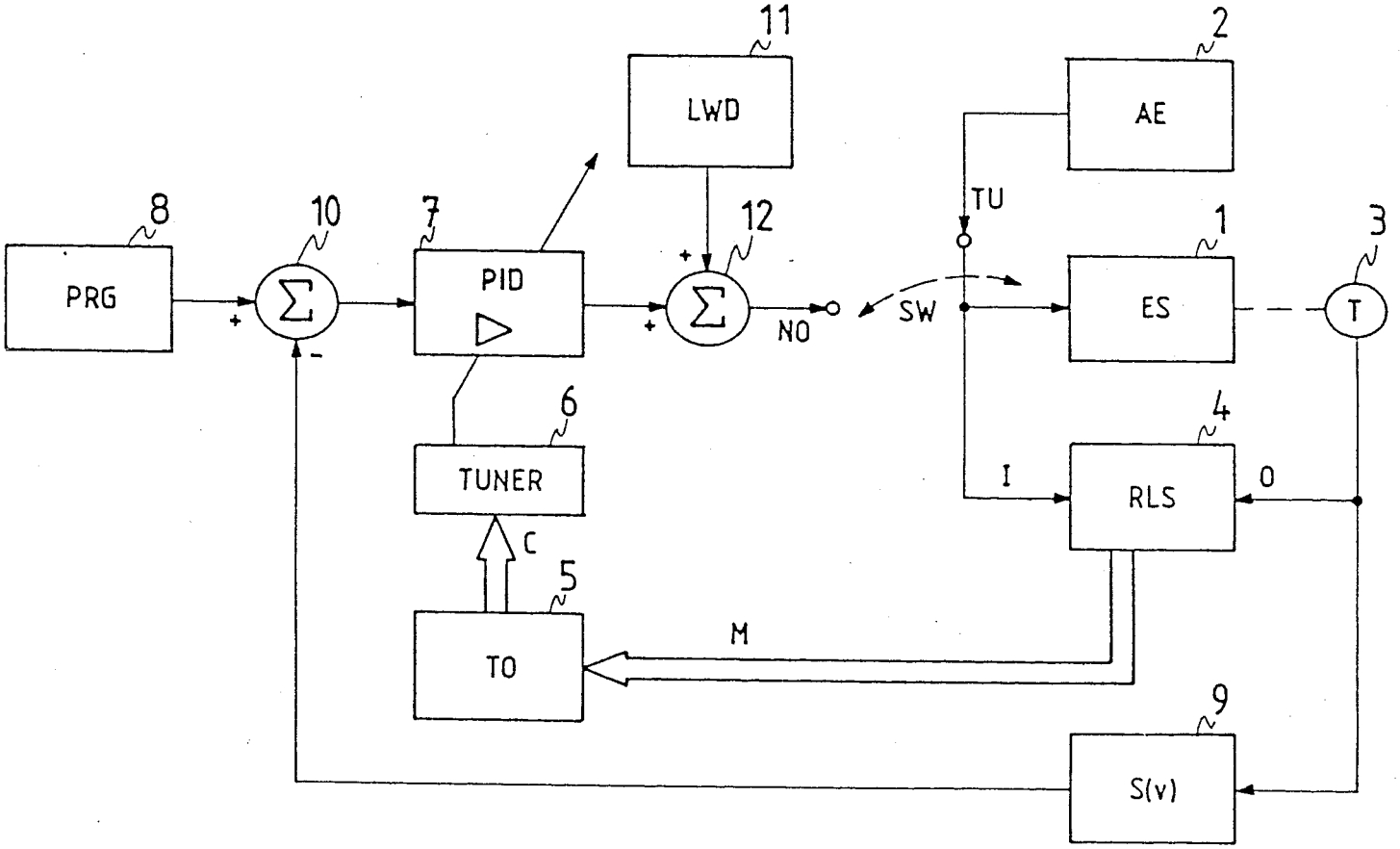

The optimization is performed in seven stages by the digital position controller, either as part of the basic programs of such a controller or as a separate unit, along the principle illustrated in FIG. 1, representing a position servo unit provided with a tuning device. In the first stage, an artificial excitation sequence TU, e.g. wide-band noise from the unit (AE) 2, is supplied to the elevator system (ES) 1 via switch SW, and the response corresponding to the excitation signal is measured, e.g. the speed is measured by a tachometer (T) 3. In the second stage, using the excitation sequence I and the speed O as the starting data, a mathematical model M of the system is calculated in the unit (RLS) 4 e.g. by the least squares method as described in "Theory and Practice of Recursive Identification" by L. Ljung and T. Söderström (MIT press, Cambridge, MA, U.S.A., 1983). In the third stage, the behaviour of the elevator system is simulated in a computer and, using the minimum-p method, control parameter C values minimizing the difference between the target function and the result function are found. The values of the control parameters C are obtained by optimising the values of the model M in an optimization unit (TO) 5.

The difference e(i) is described by the equation $$e(i)=c(i)\,[r(i-d)-y(i)]^2 \qquad (1)$$

where i=1, 2, . . . , m r(i)=value of the target function (target position value from the generator (PRG) 8) at instant (i) p1 y(i)=value of the result function (actual position value, which is obtained by integrating the actual speed in an integrating unit (S(v) 9) at instant (i)

d=delay between target function and result function c(i)=weighting factor

The difference between the target position value and the actual position value is obtained from a differential circuit (Σ) 10.

The weighting factor c(i) has a value=1 except in the immediate vicinity of the ultimate target position, where the differences are weighted by a large factor on the order of, for example, 10,000. Such weighting ensures that optimal stopping characteristics are achieved. The closed-loop system is always stable when control parameter values obtained by iteration are used.

In the fourth stage, the digital position controller (PID) 7 is tuned by feeding the optimized control parameters C via the tuner (TUNER) 6 into the controller 7. In the fifth stage, a real excitation signal NO is input via switch SW to the elevator drive system (ES) 1. In the sixth stage, the model parameter values are calculated again. In the seventh stage, stages 1–6 are repeated until the model parameter values and the control parameter values converge.

Below is an example illustrating the tuning of an optimal PID position controller. The digital PID algorithm is $$m(n+1) = m(n) + KC\left[\left(1 + \frac{T}{Ti} + \frac{Td}{T}\right)e(n) - \left(1 + 2\frac{Td}{T}\right)e(n-1) + \frac{Td}{T}e(n2)\right] \quad (2)$$

where

Kc=relative gain

Ti=integration time constant

Td=derivation time constant

T=sampling interval m(n)=controller output at instant n e(n)=difference between target position value and actual process output at instant n We use the notation P=Kc, TI=T/Ti and TD=Td/T (the parameters to be optimized).

The elevator model used is the numeric model of a d.c. driven elevator. For this elevator, the numerically identified discrete transfer function (speed/current reference) is $$H(z) = \frac{2.7140\text{E-}2 - 8.2442\text{E-}2z^{-1} + 6.3082\text{E-}2z^{-2}}{1 - 1.7051z^{-1} + 0.70887z^{-2}} \quad (3)$$

The sampling frequency is 29.4 Hz.

The tuning program is given the following initial values:

P=1.0 (gain)

TI=0.0 (integration)

TD=100 (derivation)

d=27 m=113 p=2 c(i)=1 when i=1, . . . , 93 c(i)=10,000 when i=94, . . . , 113

The specifications of the target function (target position value) are:

Distance travelled=2 m

Acceleration/deceleration=1 m/s$^2$

Rate of change of acceleration/deceleration=2.5 m/s$^3$

The iteration advances as shown by the table below.

| N | P | TI | TD | DIFFERENCE |
|---|---|---|---|---|
| 1 | 1.512150 | −0.00379583 | 41.9215 | 0.565341E3 |
| 2 | 0.847566 | −0.00366833 | 59.8217 | 0.188979E3 |
| 3 | 0.637460 | −0.00179276 | 72.4777 | 0.481527E2 |
| 4 | 0.503186 | −0.00125536 | 86.2565 | 0.190194E2 |
| 5 | 0.509150 | −0.00193232 | 88.5911 | 0.978937E0 |
| 6 | 0.510998 | −0.00188863 | 88.1934 | 0.877784E0 |
| 7 | 0.510977 | −0.00189038 | 88.2042 | 0.877783E3 |

Using the control parameters calculated above, the elevator will stop accurately at the target level in ideal circumstances. For the two-meter drive, the maximum overtravel is only 0.5 mm. In a real system, the overtravel depends on the accuracy of the position measurement. Since the adequacy of the control parameters produced by the proposed tuning algorithm is strongly dependent on the accuracy of the system model available and on the stability of the model parameters, special care must be taken to ensure that the sampled data used for identification are free of interference.

When a PID controller tuned by the optimization method described above is used, good results are achieved if the characteristics of the system to be controlled remain nearly constant. Long-term changes can be compensated by automatically tuning the control parameters e.g. once a month.

Variations in the system's dynamic characteristics depending on the load and car position can be compensated by means of a parameter table, stored in the memory of the controller computer, which contains the control parameters corresponding to different load/position combinations. The values in this table are tuned by the procedure mentioned above. The intermediate values between the discrete values stored in the table are calculated, using a known method of interpolation, by the controller computer. The load weighing device (LWD) 11 is used to soften the start and the information provided by it is added to the real excitation signal in the summing circuit (Σ) 12.

Using a PID controller, the procedure of the invention yields optimal stopping characteristics for the travel parameters of the tuning reference (distance, speed, acceleration/deceleration, derivatives of acceleration and deceleration). The applicable range of optimal stopping can be extended by using controller constructions of a more general design, based on the rational transfer function.

Figures 2A, 2B, 2C:
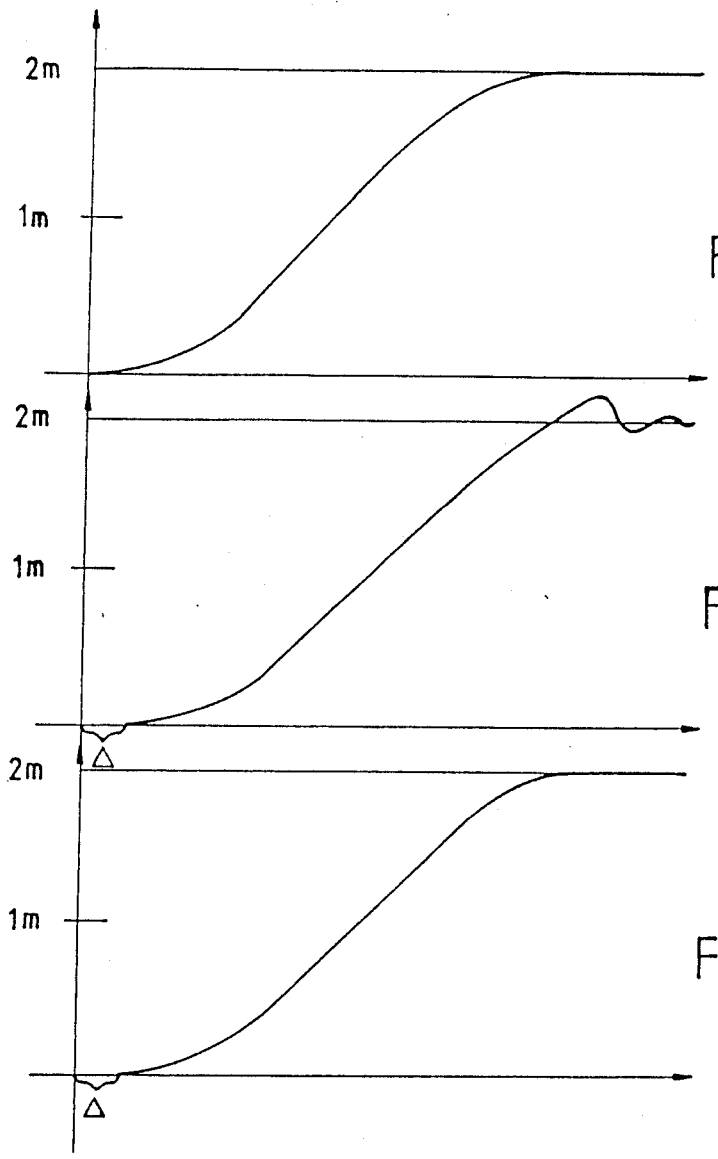

Referring to FIG. **2*b*, around the line representing a distance of 2 m, oscillations typical of step response tuning methods are observed. FIG. 2*c* shows a curve representing the actual elevator position in a system provided with a position controller tuned by the procedure of the present invention. This procedure, based on the weighting of the difference term, ensures that the elevator will stop accurately at the destination level. The in each of FIGS. 2*b* and 2*c*** represents the time during which inertial forces are being overcome by the system.

It is obvious to a person skilled in the art that different embodiments of the invention are not restricted to the examples discussed above, but that they may instead be varied in the scope of the following claims.

I claim:

1. A procedure for tuning a position controller of an elevator drive system in an elevator system, wherein an artificial excitation signal is supplied to said position controller of said elevator drive system, the response corresponding to said artificial excitation signal is measured, a mathematical model of said elevator system is calculated, the behaviour of said elevator system is simulated, position control parameter values minimizing the difference between the values for target positions and the values for actual positions are calculated, individual differences in the vicinity of the ultimate target position are weighted by a large factor, said position control parameter values are reset to optimized values, a real excitation signal is input to said elevator drive system, said model parameter values are calculated again, and the above sequence of operations is repeated until said model parameter values and said control parameter values converge.

2. A procedure according to claim 1, wherein in order to calculate said control parameter values, the minimum-p method is used.

3. A procedure according to claim 1 wherein the controller used in the procedure is a digital PID controller.

4. A procedure according to claim 1 wherein long-term changes are compensated for by automatically calculating said control parameter values at regular intervals.

5. A procedure according to claim 1 wherein variations in dynamic characteristics of the elevator system are compensated for by means of a table of parameters stored in memory.

6. A procedure according to claim 2 wherein the controller used in the procedure is a digital PID controller.

7. A procedure according to claim 2 wherein long-term changes are compensated for by automatically calculating said control parameter values at regular intervals.

8. A procedure according to claim 2 wherein variations in dynamic characteristics of the elevator system are compensated for by means of a table of parameters stored in memory.

9. A procedure according to claim 3 wherein long-term changes are compensated for by automatically calculating said control parameter values at regular intervals.

10. A procedure according to claim 3 wherein variations in dynamic characteristics of the elevator system are compensated for by means of a table of parameters stored in memory.

* * * * *